US005609143A

United States Patent [19]

Schellenberg et al.

[11] Patent Number: 5,609,143

[45] Date of Patent: Mar. 11, 1997

[54] EXHAUST GAS RECIRCULATION VALVE FOR AN INTERNAL COMBUSTION ENGINE

[75] Inventors: Gerhard Schellenberg, Fellbach; Johannes Meiwes, Markgroeningen, both of Germany

[73] Assignee: Robert Bosch GmbH, Stuttgart, Germany

[21] Appl. No.: 559,232

[22] Filed: Nov. 17, 1995

[30] Foreign Application Priority Data

Nov. 18, 1994 [DE] Germany ..... 44 41 091.3

[51] Int. Cl.[6] ..... F02M 25/07

[52] U.S. Cl. ..... 123/568; 123/571

[58] Field of Search ..... 123/568, 569, 123/570, 571; 73/117.3

[56] References Cited

U.S. PATENT DOCUMENTS

| | | | |
|---|---|---|---|
| 4,148,286 | 4/1979 | Kohama et al. | 123/568 |
| 4,177,777 | 12/1979 | Maruyama et al. | 123/571 |
| 4,206,729 | 6/1980 | Kawai et al. | 123/568 |
| 4,327,699 | 5/1982 | Reiff et al. | 123/568 |
| 4,566,423 | 1/1986 | Kenny et al. | 123/571 |
| 4,620,520 | 11/1986 | Maisch et al. | 123/568 |
| 4,727,848 | 3/1988 | Stumpp et al. | 123/569 |
| 4,942,860 | 7/1990 | Chujo et al. | 123/571 |
| 5,163,295 | 11/1992 | Bradshaw | 123/568 |
| 5,203,313 | 4/1993 | Rotarius | 123/571 |
| 5,241,940 | 9/1993 | Gates | 123/568 |

FOREIGN PATENT DOCUMENTS

| | | |
|---|---|---|
| 0083852 | 12/1982 | European Pat. Off. . |
| 4227739 | 8/1992 | Germany . |
| 4301655 | 1/1993 | Germany . |
| 4325169 | 9/1994 | Germany . |

*Primary Examiner*—Willis R. Wolfe

*Attorney, Agent, or Firm*—Edwin E. Greigg; Ronald E. Greigg

[57] ABSTRACT

An exhaust gas recirculation valve which comprises a stub pipe which protrudes into a pipe and with whose opening a valve element interacts, which valve element is moved by an actuator, the actuator being connected to the stub pipe by means of a connecting part in such a way that the above mentioned parts can be jointly inserted through a first opening into the pipe, a closing part of the stub pipe closing a second opening of the pipe, at which location an outwardly protruding end of the stub pipe is connected to an exhaust gas recirculation conduit. The connecting part advantageously also serves to relay measurements of a measurement recording device, recorded at the stub pipe to the analysis device of the measuring device.

23 Claims, 2 Drawing Sheets

EXHAUST GAS RECIRCULATION VALVE FOR AN INTERNAL COMBUSTION ENGINE

PRIOR ART

The invention is based on an exhaust gas recirculation valve for an internal combustion engine. In such an exhaust gas recirculation valve known from DE-C 43 25 169, a pipe conduit part is provided which is designed as an intermediate piece for insertion in an air conduit. The pipe conduit part has an opening in the pipe wall on one side and a stub pipe connected the exhaust gas recirculation conduit can be introduced into the pipe through this opening. This stub pipe has a flange by means of which it is tightly connected to a flange surrounding the opening. Opposite the stub pipe, a guide stub pipe is formed in the wall of the pipe for the tight guidance of a stem; a valve disk, which interacts with the opening of the stub pipe, is attached to the end of the stem. At its end protruding from the pipe, the stem is connected to a pneumatic actuator. This exhaust gas valve has, on the one hand, to be fitted in a complicated manner into the air conduit of the internal combustion engine and, on the other hand, has to be assembled by means of complicated assembly work. Such exhaust gas recirculation valves are used for metering exhaust gas recirculation quantities which are controlled by opening or closing the exhaust gas valve by means of the actuator. For accurate metering of the exhaust gas recirculation quantities it is, furthermore, also necessary to measure the recirculated exhaust gas quantities. It is only then that accurate control of the exhaust gas recirculation quantities can take place. Such measurement, finally, also permits conclusions as to the functional capability of the exhaust gas recirculation valve. Such a device is not provided in the known exhaust gas recirculation valve.

ADVANTAGES OF THE INVENTION

The exhaust gas recirculation valve has, in contrast, the advantage that measurement of exhaust gas recirculation quantities is possible and that, in addition, a location immediately adjacent to the actual inward flow location of the recirculated exhaust gas is used for recording the exhaust gas recirculation quantities. Particularly where the exhaust gas recirculation quantity is introduced directly into the fresh air flow by means of the stub pipe, the advantage arises that the measurement location is cooled in a very effective manner by the air flow without additional measures having to be taken. This improves the reliability of the measurement.

In a particularly advantageous further development, the valve element, together with its actuator, can be inserted through an opening provided in the pipe and, by this means, a connection with the measurement location on the stub pipe can be produced at the same time. This has the advantage that the actuator and the valve element can be pre-assembled in a simplified manner and can be easily inserted into the pipe, which can for example be part of the induction system of the internal combustion engine. The pipe can, on the other hand, also be a continuation of the exhaust gas recirculation conduit, this providing the same advantageous assembly possibilities. In a further development of this embodiment the actuator, the valve element and the stub pipe are combined in one structural unit so that this unit can be inserted in preassembled form and in a simple manner from one side of the pipe. This is also particularly advantageous where the exhaust gas recirculation valve is not provided with a measurement location on the stub pipe.

The further development in accordance with the invention has the advantage that the recording of the measured parameters and their analysis can take place at separate locations. Thus, the analysis device is associated with the actuator outside the pipe. This avoids long conduit connections and has the advantage of forming a compact arrangement.

In accordance with the invention, a cross-sectional contraction of the exhaust gas stub pipe is provided as the device for recording the measurements for the exhaust gas recirculation quantities and, in this arrangement, the pressures upstream and downstream of the cross-sectional contractions are recorded and analyzed. This can either take place by means of pressure sensors arranged locally on the stub pipe or it can take place, by means of control openings which are provided upstream and downstream of the cross-sectional contraction and which relay the pressures present there by means of pipe conduits to the analysis device on the actuator. These pipe conduits can then be integrated, in a particularly advantageous manner in accordance with the connecting part connecting the actuator to the stub pipe. This thus provides a particularly compactly constructed unit which can be very easily installed in an existing pipe of the internal combustion engine. Particular advantages follow from the fact that this compact unit, can be installed in the air induction system of the internal combustion engine, the stub pipe carrying exhaust gas recirculation quantities, together with pressure sensors Which may be provided directly on the stub pipe, being optimally cooled. In this case, furthermore, the actuator is no longer subjected to the hot exhaust gas but is likewise cooled by the air flowing in the air induction pipe in such a way that the actuator can be constructed from moulded plastic parts, which is particularly economical.

BRIEF DESCRIPTION OF THE DRAWINGS

An embodiment example of the invention is represented in the drawing and is explained in more detail in the following description.

DETAILED DESCRIPTION OF THE EMBODIMENT EXAMPLE

Figure 1:
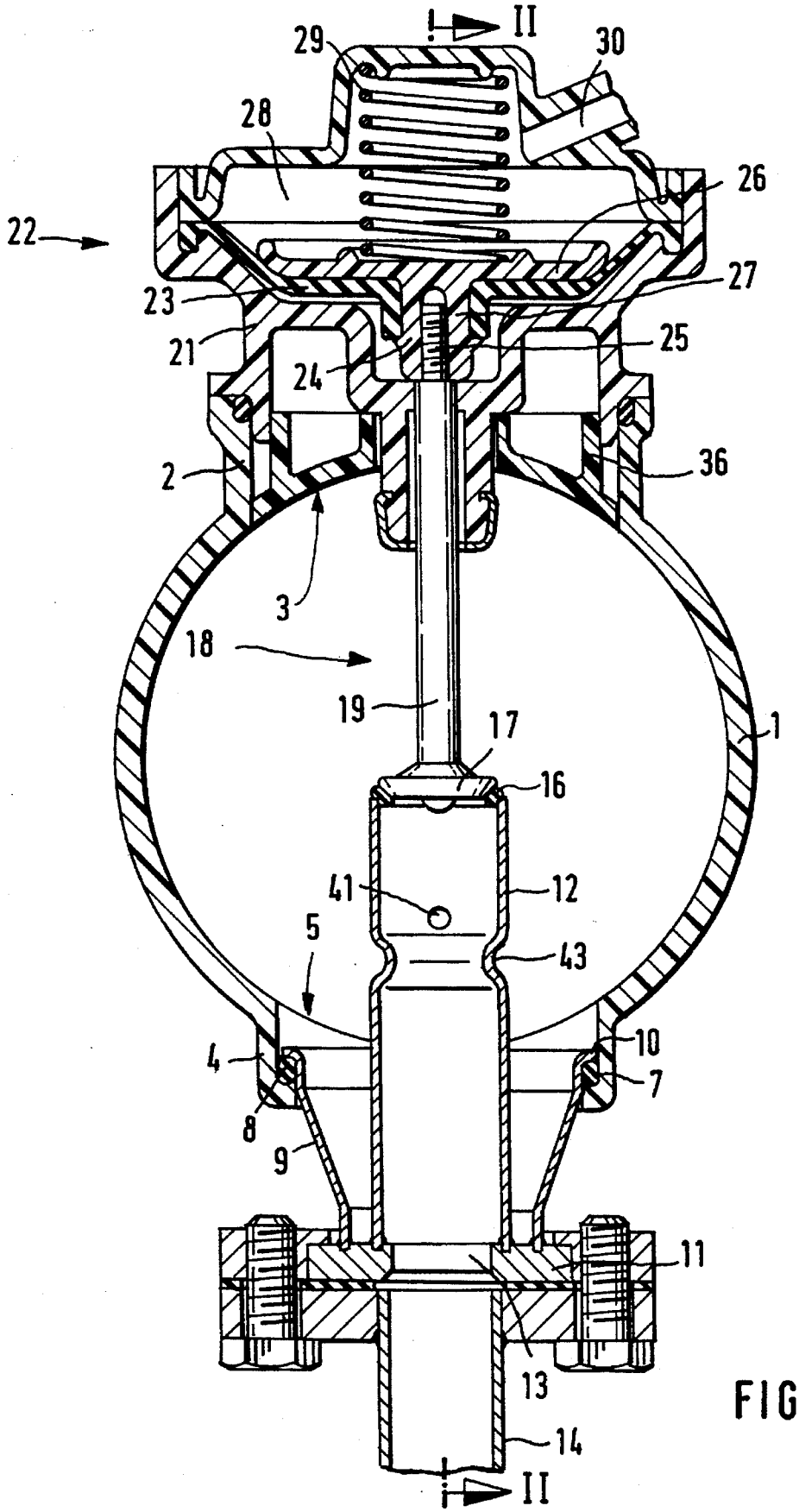
FIG. 1 shows a first longitudinal section through the pipe together with the exhaust gas recirculation valve.

In the embodiment example reproduced in the drawing, an air flow pipe 1 is shown which can be part of an air induction system of an internal combustion engine or can also be part of an exhaust gas recirculation conduit, in the case of a configuration with a smaller diameter. In its peripheral wall, this pipe has a first pipe stub connection 2 which forms a first opening 3 in the wall of the pipe 1 and a second pipe stub connection 4 which is diametrically opposite to the first pipe stub connection 2, which forms a second opening 5 in the wall of the pipe 1. In this arrangement, the diameter of the first opening 3 is larger than the diameter of the second opening 5. The second pipe stub connection 4 is pulled in at its outermost external end so as to form an annular shoulder 7 facing towards the inside of the sub connection 4. A closing part 9 (which is formed from sheet metal) comes into contact with the shoulder 7—by means of a shaped part 10 which is in the form of a flange and faces radially outwards with a seal 8 being placed between them. The closing part is configured approximately in the shape of a truncated cone and forms a recess in the run of the pipe. It is permanently connected, for example soldered, to a plate 11 at its end opposite to the shaped part 10. The end of a stub pipe 12 is, in addition, fastened to the plate 11 concentrically with the closing part 9 and within the latter. This stub pipe 12 can likewise be soldered to the plate and encloses a hole 13 through the plate. This hole forms a passage with a diameter equal to the diameter of a recirculation conduit 14 flanged onto the plate 11.

The stub pipe 12 protrudes diametrically and coaxially with respect to the first opening 3 and the second opening 5, into the pipe 1 and has a valve seat 16 on its inner end surface. A valve disk 17 of a valve element 18 of the exhaust gas recirculation valve according to the invention comes into contact with the valve seat 16. The valve disk is located at the end of a valve stem 19 whose other end is guided in a casing 21 of an actuator 22. The latter is inserted, by means of its casing 21, into the first pipe stub connection 2 so that it tightly closes the opening 3. In the illustrated embodiment, the actuator consists of a pneumatically operated pressure capsule with an actuator diaphragm 23, which is clamped between two casing halves and to which the end 25 of the valve stem is connected by suitable means 24. These means include a spring plate 26, which is of stable shape and has a blind hole 27 for fixing the shaped neck of the actuator diaphragm 23. A fir-tree profile of the valve stem is pressed into the blind hole 27.

A return spring 29 is clamped in the working space 28 enclosed in the casing 21 by the actuator diaphragm 23 and is supported between the spring plate and the casing. The appropriate control pressure is supplied to the working space 29 by means of a pressure conduit 30.

Figure 2:
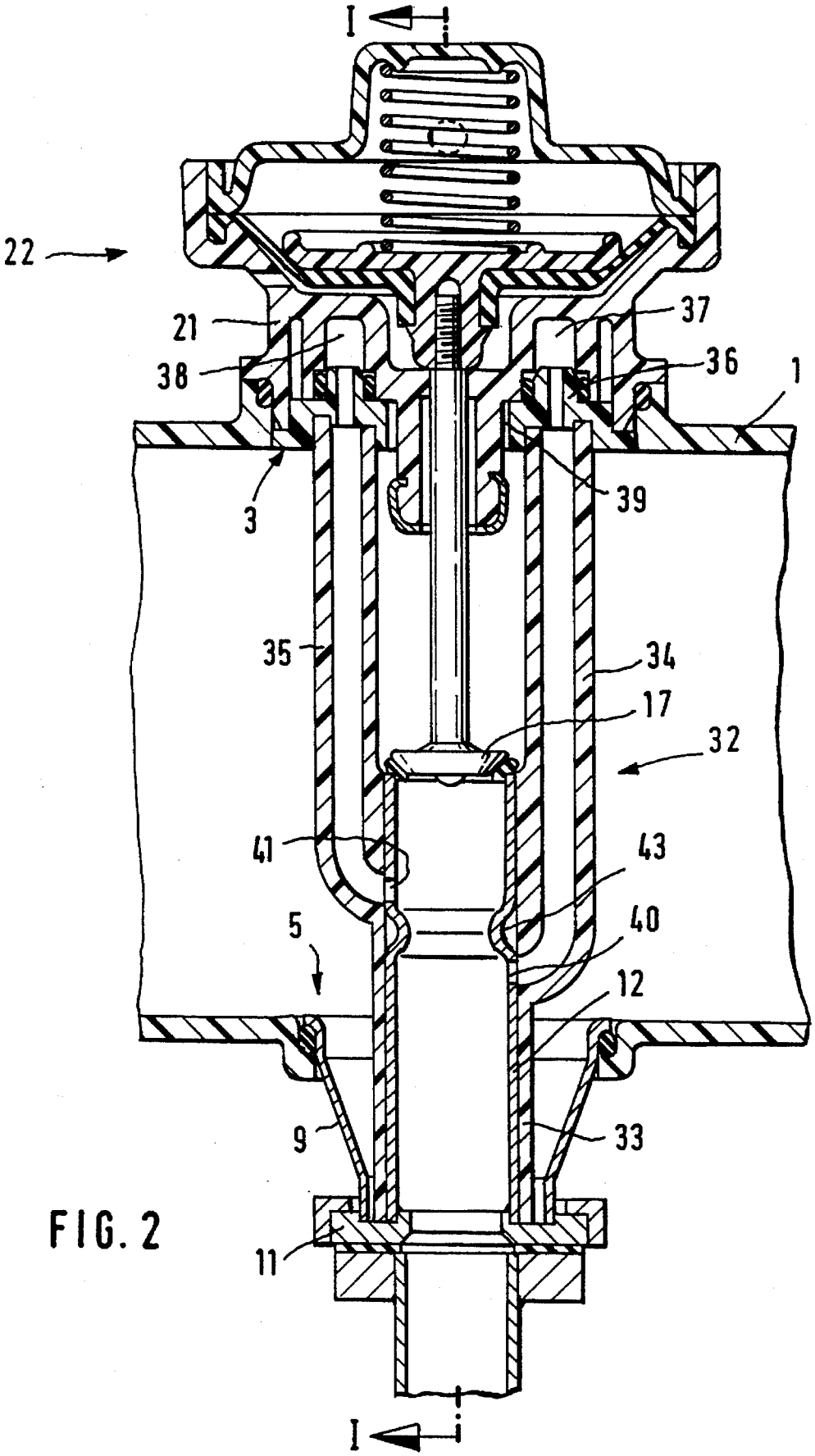
FIG. 2 shows a section at right angles to the representation shown in FIG. 1.

In a further embodiment of the exhaust gas recirculation valve of FIG. 1, it can be seen from a different section, in FIG. 2, that the stub pipe 12, together with the closing part 9 and the plate 11, is connected to the casing 21 of the actuator 22 by means of a connecting part 32. This connecting part consists of a part 33, which encompasses the stub pipe 12 from the outside and in which are enclosed a first pipe conduit 34 and a second pipe conduit 35. These pipe conduits extend offset relative to the stub pipe 12, and with their axes parallel to the latter, towards the first opening 3 and there open into a connecting piece 36 which is in turn again connected to the casing 21 and, via the latter, to the pipe stub connection. Enclosed between the pipe stub connection and the casing 21, there are pressure spaces 37 and 38 which have connection to a device, not represented in any more detail, for analyzing the pressure difference between the pressure reaching the pressure space 37 via the first pipe conduit 34 and the pressure reaching the pressure space 38 via the second pipe conduit 35. The first pipe conduit 34 and the second pipe conduit 35 are permanently connected to the connecting part 32 and the casing 21 so that these items, together with the stub pipe 12, the closing part 9 and the plate 11, form a part, which can be handled jointly, in such a way that this part can be introduced through the first opening 3 into the pipe 1 and part of it can be led out again from the pipe 1 through the second opening 5 until the closing part 9 comes into contact, via the seal 8, with the annular shoulder 7. At this point, the casing 21 of the actuator 22 has also tightly closed the first opening 3. In this manner, the exhaust gas recirculation valve can be inserted in a very simple manner into the pipe 1, which substantially simplifies the assembly and also reduces the cost of producing the exhaust gas recirculation valve.

It is conceivable that the connecting piece 36 and the casing 21 of the actuator 22 could be configured in two parts and be inserted one after the other into the opening 3 of the first pipe stub connection. Appropriate seals between these two parts are then necessary. The connecting piece 36 then has an axial through opening 39 which is sufficiently large for the valve disk 17 to be fed through it. After the casing 21 of the actuator has been placed in position, the pipe 1 is then tightly closed toward the outside again. In this arrangement, however, the through feed of the valve stem to the actuator diaphragm does not have to be completely sealed because a reference pressure space connected to the surroundings is present between the actuator diaphragm 23 and the part of the casing on the valve stem side.

An exhaust gas recirculation valve configured in this way makes it possible to measure the exhaust gas recirculation quantity supplied if a diameter contraction 43 is provided between the opening 40 of the first pipe conduit 34 into the stub pipe 12 and the opening 41 of the second pipe conduit 35 into the stub pipe. By virtue of said diameter contraction 43 a differential pressure is formed between the stub pipe regions located upstream and downstream of the diameter contraction and this depends, in known manner, on the quantity flowing through, in this case the exhaust gas recirculation quantity flowing through. The pressures occurring are recorded by the analysis device described above.

It is, furthermore, conceivable for these pressures to be recorded on site by electronic pressure recorders whose measurements are led out via connecting lines in an appropriately configured connecting part 32 to the actuator 22 and are there supplied to a corresponding control device.

The connecting part, particularly in the embodiment of the type shown in FIG. 2, is preferably built up from stamped sheet-metal parts. The closing part 9 and the stub pipe 12 are preferably also stamped from sheet metal. In the case in which the pipe 1, in particular, is used for the supply of air with exhaust Gas supplied via the exhaust Gas valve, on the other hand, the casing 21 of the actuator 22 can consist of moulded plastic parts since the heat supplied by the exhaust gas recirculation is rapidly transported away again by the intensive cooling due to the air flow supplied. Particularly in the case where electronic pressure recorders are provided on the stub pipe, the connecting part 32 is again also optimally cooled by the air passing over it so that in this case, the best conditions are possible for recording measurements with small demands made on the measurement pick-up. The funnel-shaped configuration of the closing part 9, which permits an even longer length for the flow around the stub pipe 12, is advantageous in this case.

The foregoing relates to preferred exemplary embodiments of the invention, it being understood that other variants and embodiments thereof are possible within the spirit and scope of the invention, the latter being defined by the appended claims.

I claim:

1. An exhaust gas recirculation valve for controlling exhaust gas recirculation quantities which are supplied to an induction side of an internal combustion engine, comprising an air flow pipe (1), a stub pipe (12), which protrudes into said pipe (1), said stub pipe (12) is connected to the exhaust gas collecting system, which forms part of an exhaust gas recirculation conduit (14), a valve set (16) is formed on an end-face opening on which a valve element (18) actuated by an actuator (22) interacts, wherein the valve element (18) is configured as a disk valve element with a valve disk (17) at one end of a valve stem (19) which protrudes into the air flow pipe (1) through a first opening (3), opposite the stub pipe (12), in the wall of the air flow pipe and the actuator (22) is rigidly and releasably connected to the pipe in the region of the first opening (3) by means of a casing (21) and the casing (21) has a rigid connection to the stub pipe (12)

by means of a connecting part (32), and a second opening (5), in the wall of the air flow pipe (1), opposite to the first opening (3), said second opening (5) can be closed by a closing part (9) which is permanently connected to the stub pipe (12) to position said stub pipe and, together with the stub pipe (12) can be inserted into the pipe (1) through the first opening (3).

2. The exhaust gas recirculation valve as claimed in claim 1, wherein a measuring device for recording exhaust gas quantities supplied through the exhaust gas recirculation valve is arranged on the stub pipe (12) and openings (34, 35) lead form the measuring device via the connecting part (32) and the casing (21) of the actuator (22) top an analysis device for the values recorded by the analysis device.

3. The exhaust gas recirculation valve as claimed in claim 2, wherein the stub pipe (12) and the closing part (9) are manufactured from thin-walled sheet metal and are permanently and rigidly connected together by means of a plate (1) which is also used for connecting the stub pipe (12) to the exhaust gas recirculation conduit (14).

4. The exhaust gas recirculation valve as claimed in claim 1, wherein the stub pipe (12) and the closing part (9) are manufactured from thin-walled sheet metal and are permanently and rigidly connected together by means of a plate (1) which is also used for connecting the stub pipe (12) to the exhaust gas recirculation conduit (14).

5. The exhaust gas recirculation valve as claimed in claim 4, wherein the casing (21) accommodating the actuator (22) is manufactured from plastic.

6. The exhaust gas recirculation valve as claimed in claim 4, wherein the connecting part (32) comprises stamped sheet-metal parts joined together, which parts are permanently connected to the stub pipe, on and to the casing.

7. The exhaust gas recirculation valve as claimed in claim 6, wherein the closing part (9) forms a recess in a run of the air flow pipe (1) with the stub pipe (12) freely protruding into the pipe through this recess.

8. An exhaust gas recirculation valve for controlling exhaust gas recirculation quantities which are supplied to an induction side of an internal combustion engine, comprising an air flow pipe (1), a stub pipe (12) which protrudes into said pipe (1), said stub pipe is connected to an exhaust gas collecting system, which forms part of an exhaust gas recirculation conduit (14), a valve seat (16) on an end-face opening of said stub pipe, a valve element (18) actuated by an actuator (22) interacts with said valve seat, at least one part of a measuring device in the form of a measurement recording device for recording exhaust gas quantities supplied through the exhaust gas recirculation valve is arranged on the stub pipe (12) upstream of an opening into the air flow pipe (1).

9. The exhaust gas recirculation valve as claimed in claim 8, wherein the air flow pipe (1) is part of an air induction system of the internal combustion engine.

10. The exhaust gas recirculation valve as claimed in claim 8, wherein the valve element (18) is configured as a disk valve element with a valve disk (17) at one end of a valve stem (19) which protrudes into the air flow pipe (1) through an opening (3) in said air flow pipe opposite the stub pipe (12), and the actuator (22) is releasably connected to the pipe in a region of a first opening (3) and has a permanent connection to that part on the stub pipe (12) which forms at least part of the measuring device.

11. The exhaust gas recirculation valve as claimed in claim 10, wherein an analysis device for the measurement recorded is associated with the actuator (22), as another part of the measuring device.

12. The exhaust gas recirculation valve as claimed in claim 8, wherein an analysis device for the measurement recorded is associated with the actuator (22), as another part of the measuring device.

13. The exhaust gas recirculation valve as claimed 12, wherein a second opening (5), diametrically opposite the first opening in the wall of the pipe (1) is provided in the wall of the air flow pipe (1), and the stub pipe (12), together with a closing part (9) positioning the stub pipe (12) and closing the second opening (5) is fed through the first opening (3), the stub pipe (12) being rigidly connected to the casing (21) by means of a connecting part (32) accommodating conduits (34, 35).

14. The exhaust gas recirculation valve as claimed in claim 13, wherein the connecting part (32) comprises stamped sheet-metal parts joined together, which parts are permanently connected to the stub pipe, and to the casing (21).

15. The exhaust gas recirculation valve as claimed in claim 14, wherein the closing part (9) forms a recess in a run of the pipe with the stub pipe (12) freely protruding into the pipe (1) through this recess.

16. The exhaust gas recirculation valve as claimed in claim 14, wherein the cross-sectional contraction (43) on the stub pipe (12) is manufactured by deforming the stub pipe wall.

17. The exhaust gas recirculation valve as claimed in claim 16, wherein the stub pipe (12) and the closing part (9) are manufactured from thin-walled sheet metal and ar permanently and rigidly connected together by means of a plate (11) which is also used for connecting the stub pipe to the exhaust gas recirculation conduit (14).

18. The exhaust gas recirculation valve as claimed in claim 12, wherein the measurement recording device includes a cross-sectional contraction (43) which is arranged in the stub pipe (12) upstream of the valve seat (16), respective pressure openings (40, 41) being arranged in a wall of the stub pipe upstream and downstream of the contraction, which pressure openings (40, 41) are connected by respective conduits (34, 35) to a casing of the actuator (22), which casing is connected to the air flow pipe and an analysis device.

19. The exhaust gas recirculation valve as claimed 18, wherein a second opening (5), diametrically opposite the first opening in the wall of the pipe (1) is provided in the wall of the air flow pipe (1), and the stub pipe (12), together with a closing part (9) positioning the stub pipe (12) and closing the second opening (5) is fed through the first opening (3), the stub pipe (12) being rigidly connected to the casing (21) by means of a connecting part (32) accommodating conduits (34, 35).

20. The exhaust gas recirculation valve as claimed in claim 18, wherein the pressure openings (40, 41) in the wall of the stub pipe from pipe conduits (34, 35) which are connected to the analysis device by means of the casing (21) of the actuator (22) and the analysis device contains a differential pressure sensor.

21. The exhaust gas recirculation valve as claimed 20, wherein a second opening (5), diametrically opposite the first opening in the wall of the pipe (1) is provided in the wall of the air flow pipe (1), and the stub pipe (12), together with a closing part (9) positioning the stub pipe (12) and closing the second opening (5) is fed through the first opening (3), the stub pipe (12) being rigidly connected to the casing (21) by means of a connecting part (32) accommodating conduits (34, 35).

22. The exhaust gas recirculation valve as claimed in claim 20, wherein the analysis device is integrated in the casing (21).

23. The exhaust gas recirculation valve as claimed 22, wherein a second opening (5), diametrically opposite the first opening in the wall of the pipe (1) is provided in the wall of the air flow pipe (1), and the stub pipe (12), together with a closing part (9) positioning the stub pipe (12) and closing the second opening (5) is fed through the first opening (3), the stub pipe (12) being rigidly connected to the casing (21) by means of a connecting part (32) accommodating conduits (34, 35).

* * * * *